United States Patent [19]

Maples

[11] 4,037,505

[45] July 26, 1977

[54] ADJUSTABLE END PIN FOR STRING BASS OR CELLO

[76] Inventor: Lea Maples, 84 Orchard Estates Drive, Walnut Creek, Calif. 94598

[21] Appl. No.: 678,152

[22] Filed: Apr. 19, 1976

[51] Int. Cl.[2] ..... G10D 1/02; G10D 3/00

[52] U.S. Cl. ..... 84/280; 84/327

[58] Field of Search ..... 84/280, 327, 281, 290, 84/329

[56] References Cited

U.S. PATENT DOCUMENTS 2,974,556 3/1961 Fawick ..... 84/280

FOREIGN PATENT DOCUMENTS 1,326 1901 United Kingdom ..... 84/280

8,787 1904 United Kingdom ..... 84/280

*Primary Examiner*—Stephen J. Tomsky

*Attorney, Agent, or Firm*—William J. Ruano

[57] ABSTRACT

An adjustable end pin for a string bass or cello. The end pin extends through a hub having a cavity containing a jam plate with a central hole through which the pin extends. The jam plate is normally biased by a spring to an angular position relative the pin to jam or lock the pin to the hub. However, upon pushing the collar to exert lever action on the jam plate to move it towards a right angular position, it will unlock the pin and allow incremental pulling out thereof from the hub to provide incremental adjustment of the height of the instrument from the floor.

3 Claims, 6 Drawing Figures

ADJUSTABLE END PIN FOR STRING BASS OR CELLO

This invention relates to an adjustable end pin for a string bass or cello.

An outstanding disadvantage of the presently used end pin attached to the bottom of a string bass or cello is that because of the weight of the instrument and the downward pressure applied by the musician, there is a great tendency of slippage of the height adjusting means, usually a thumb/set screw, requiring frequent readjustment, involving unscrewing and screwing, which is very annoying.

An object of the present invention is to provide a novel adjusting means which overcomes the above named disadvantages and which remains securely in its adjusted position regardless of the weight, even of the heaviest instrument, and downward pressure exerted by the player.

Another object of the invention is to provide a novel adjusting means for the end pin of a string bass or violin cello which is extremely easy to adjust by the application of very minimum pressure and which may be selectively adjusted to any point, that is, a multiplicity of points longitudinally of the pin, as distinguished from a few predetermined points of adjustment as presently provided on adjustable pins for these instruments.

A more specific object of the present invention is to provide a novel adjusting means for selective extension of the end pin from the instrument to provide incremental adjustment of the height of the instrument from the floor, which adjusting means is completely concealed by associated operating parts which also serve as closures so as not to detract from the appearance of the end pin.

Other objects and advantages will become more apparent from a study of the following description taken with the accompanying drawings wherein:

FIG. 1 is a perspective view of the end pin and adjusting means embodying the principles of the present invention;

FIG. 1*a* is a schematic showing, in reduced scale, of how the adjustable pin is secured to the bottom of the instrument;

Figures 1, 1A:
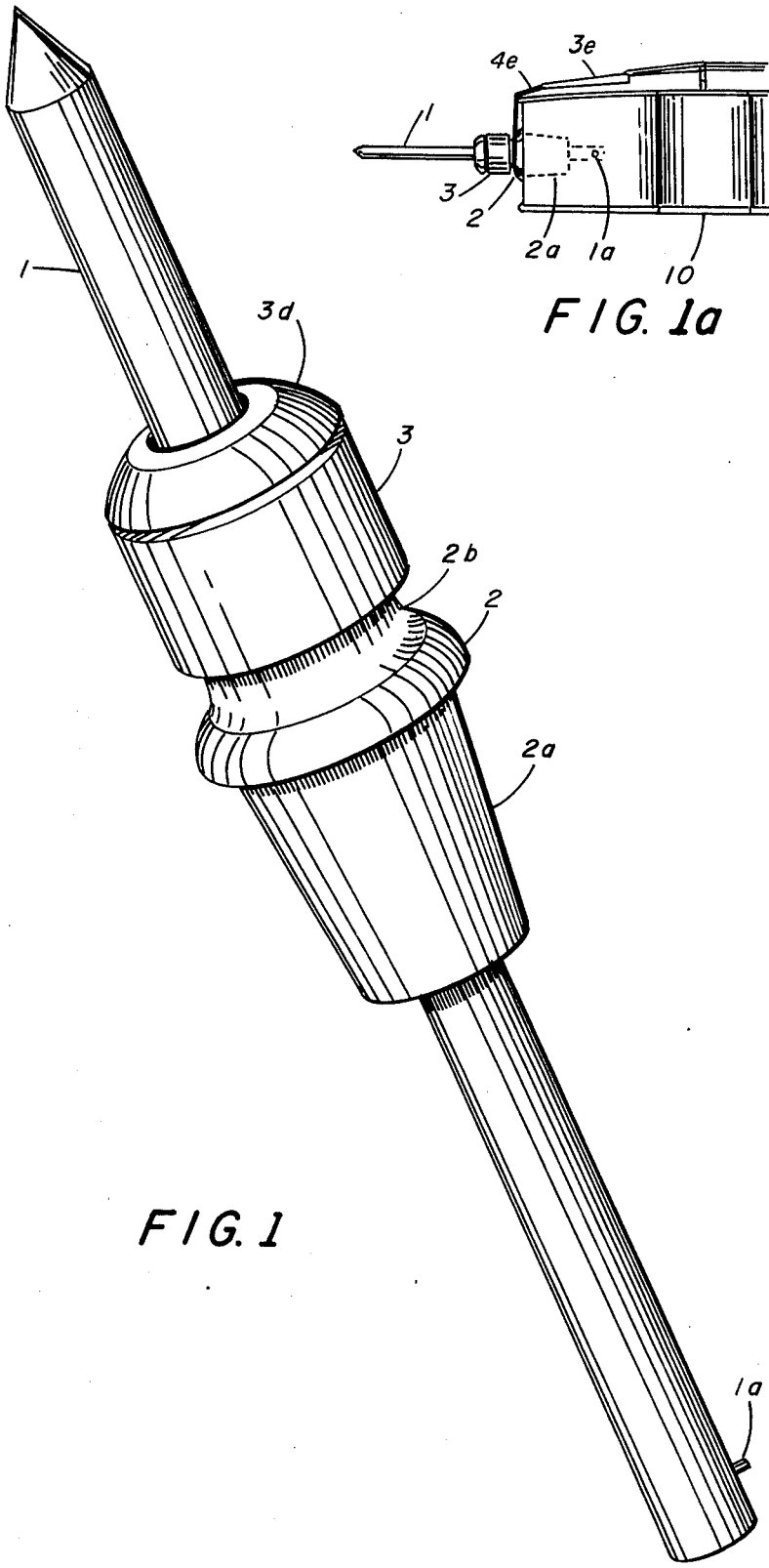

Referring more particularly to FIG. 1 of the drawings, numeral 1 denotes an end pin having a pointed end which rests on the floor and a blunt end which extends into the bottom of a string bass or cello 10, as shown more clearly in FIG. 1*a*. In order to adjustably increase the height of the instrument from the floor, the end pin 1 is selectively pulled out of the hub 2 to obtain the instrument height desired. Hub 2 has a tapered portion 2*a* inserted into a correspondingly tapered hole in the bottom or end block, forming a conventional part of the string instrument as shown in FIG. 1*a*. The string tail piece 3*e* is connected by a tail gut 4*e* which comes over the saddle and around the groove 2*b* of the hub 2. Therefore, the total tension of the strings is exerted sidewise against the hub 2. The snug tapered fit of portion 2*a* prevents any movement.

Pin 1*a* serves as a stop to prevent complete withdrawal of the pin from the instrument. When a musician is finished playing and wishes to pack up, the adjusting collar 3 together with cap 3*a* attached thereto is depressed slightly to allow the pin to be pushed to the completely retracted position into the instrument.

Figure 2:
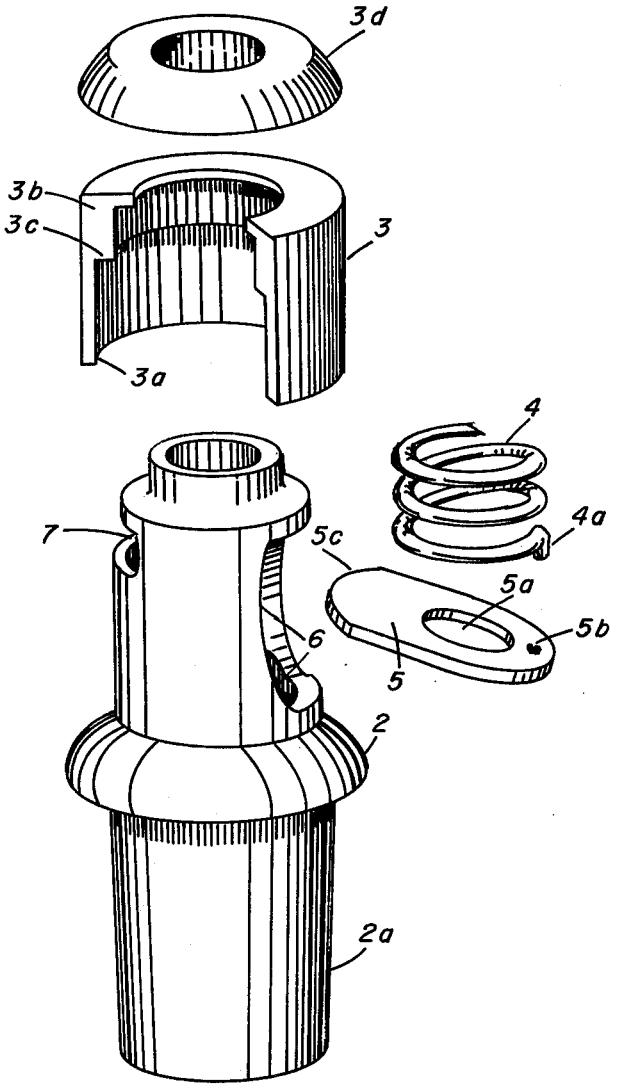
FIG. 2 is a perspective, exploded view of FIG. 1, to better illustrate the parts of the adjusting mechanism.
Figure 3:
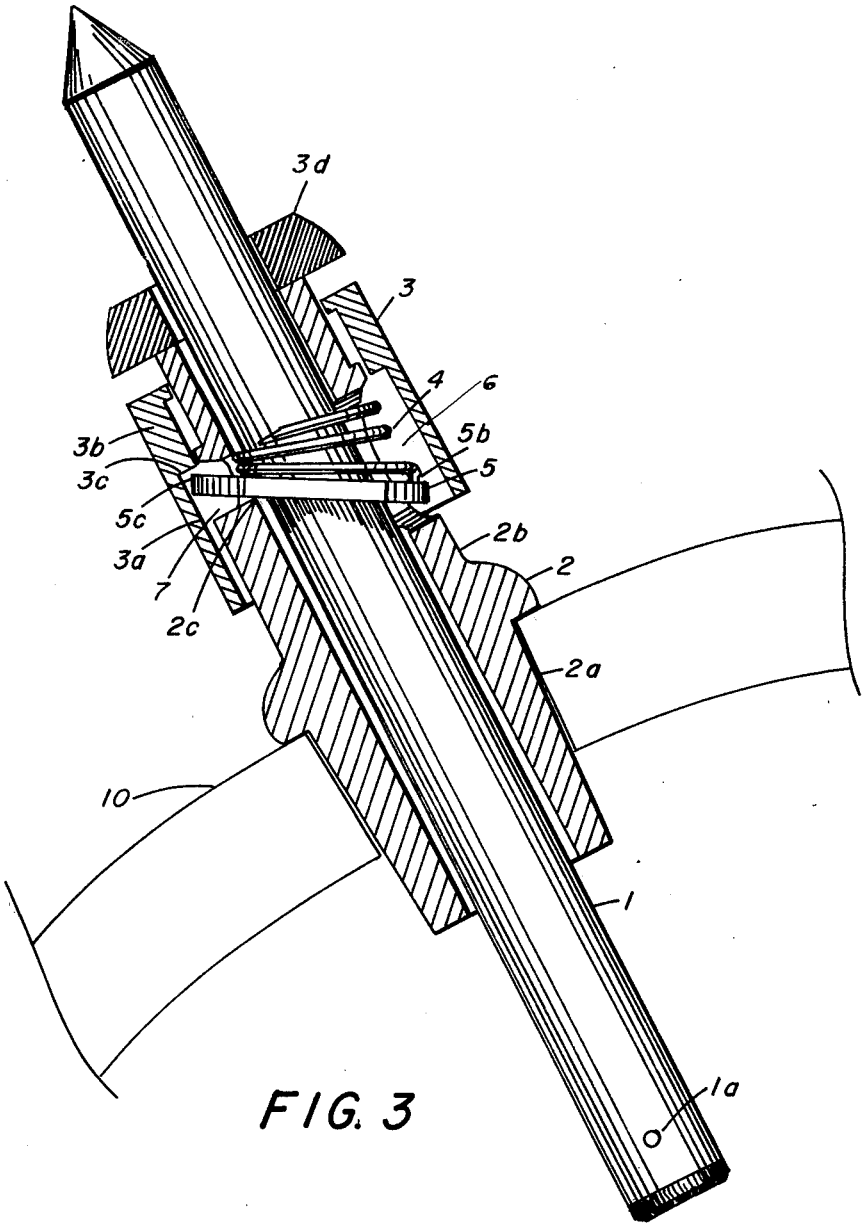
FIG. 3 is a longitudinal cross-sectional view of FIG. 1.

FIG. 1 together with FIGS. 2 and 3 which better show component parts of FIG. 1, illustrate a preferred form of the invention having a jam cavity 6 extending all the way through hub 2 angularly and terminating in an additional cut-out portion 7, as will appear more clearly in FIG. 2. The jam plate 5 has a hole 5*a* through which pin 1 extends and has a small hole 5*b* into which downwardly turned end 4*a* of the helical spring 4 extends.

The collar 3 has a collar portion 3*b* surrounding pin 1 and has a circular cut out 3*a* to provide a shoulder portion 3*c* which provides a contact portion to apply pressure, by adjustment collar 3, against the jam plate 5. Hub cap 3*d* is screw threaded to the top of hub 2.

In operation, when it is desired to retract pin 1, the adjustment collar 3 is pushed towards hub 2 to make contact with the jam plate 5, whereupon the jam plate will rock, as a lever, about fulcrum point 2*c* of hub 2 so as to release its engagement with pin 1, as the result of the movement of the edge 5*c* of the jam plate against the resistance of spring 4 to compress it and allow the jam plate to gradually assume a more right angular position relative to pin 1. By shaping the jam cavity 6, as shown in FIG. 2, with an opening 7 adjacent the fulcrum 2*c*, it is possible to pass a grinding tool angularly through the entire hub to more easily form the angular jam cavity 6, 7.

Figure 4:
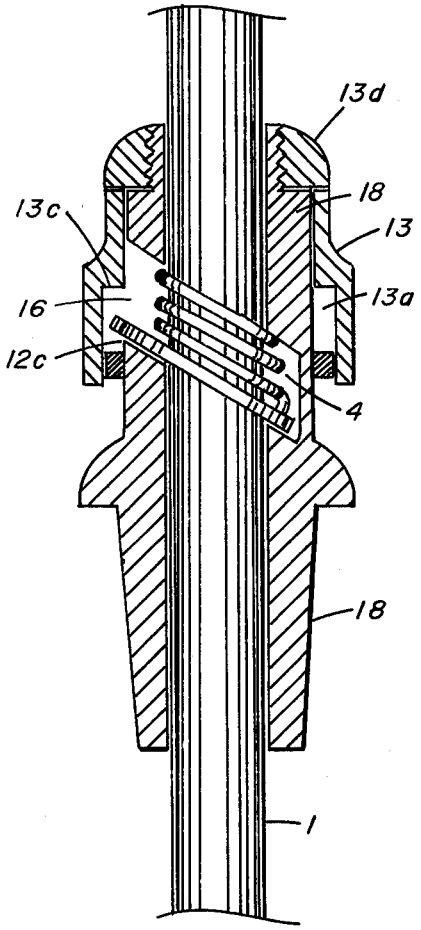
FIG. 4 is an enlarged longitudinal cross-sectional view of a modification of the adjusting pin.
Figure 5:
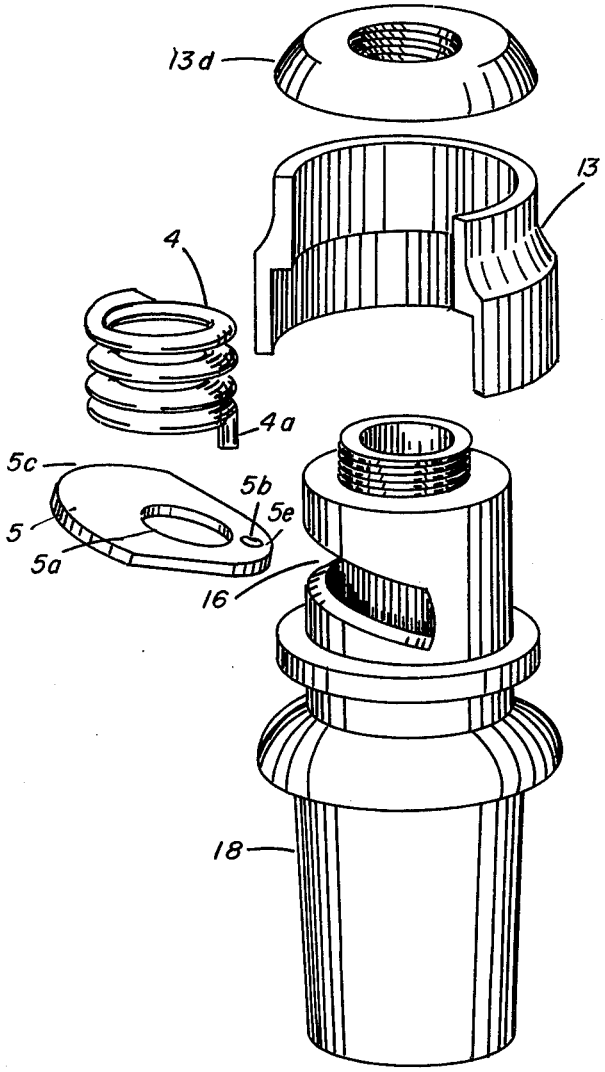
FIG. 5 is a perspective exploded view of the parts of adjusting mechanism of FIG. 4.

FIG. 4 together with FIG. 5, showing component parts thereof, show a modification of the invention. It will be noted that coil spring 4, encircling end pin 1, will normally push, at 4*a*, jam plate 5 away from adjusting collar 13. Hub 18 has a cap 13*d* screw threaded thereon and a cavity 16 therein into which projects an end of the jam plate 5. One end 4*a* of spring 4 is turned longitudinally and fits into a hole 5*b* in the jam plate. The opposite end of the spring is seated above jam cavity 16 in the hub around the pin.

Hub or housing 18 is provided with the jam cavity 16 extending angularly downwardly in the longitudinal direction and into which the jam plate extends while its hole 5 encircles end pin 1.

As the result of the angularly downwardly direction of cut-away or jam cavity 16, its high point forms a fulcrum or stop 12*c*, against which an outer edge portion 5*c* of the jam plate 5 is normally seated as the result of spring pressure of the spring 4. However, the opposite outwardly arcuate portion 5*e* of the jam plate 5 has freedom of movement in the jam cavity 16, and is arrested only engaging the surface of end pin 1, thereby providing two opposite points of binding or jamming contact, in the opening 5, with end pin 1.

To unlock or release pin 1 from jam plate 5, collar 13 is pushed, against the acting of spring 4, until the bottom 13*c* of its groove 13*a* pushes against the outer edge portion 5*c* of the jam plate 5 as a lever about the stop fulcrum point 12*c* so that the opposite end of the lever-like jam plate 5 will be pushed in the opposite direction so as to compress spring 4 and thereby release pin 1 from the jam plate 5 as a consequence of movement of end 5*e* of the jam plate towards a right angular position with respect to pin 1. Now pin 1 can be freely moved in either direction to provide selective incremental increase or decrease in the height of the instrument.

Thus it will be seen that I have provided a highly efficient, easily operable and very secure end pin adjustment for a string bass or cello, which does not slip despite the weight of the instrument or pressure exerted by the player on the instrument, — also which has infinite points of adjustment along the extent of the pin extension beyond the hub and instrument to provide selective adjustment in the height of the instrument from the floor; also, I have provided an end pin adjusting mechanism which is completely concealed from view, therefore does not mar the attractiveness of the instrument; also, I have provided an end pin which can be very easily released from a locking position and completely retracted into the hub when packing up the instrument for transportation; also, I have provided a very secure adjusting mechanism for securely locking the pin to the hub and made of relatively few simple and inexpensive parts, most of which are conventional, and of standard stock sizes, therefore making the cost exceedingly low.

While I have illustrated and described several embodiments of my invention, it will be understood that these are by way of illustration only and that various changes and modification may be contemplated in my invention and within the scope of the following claims.

I claim:

1. For use in combination with a string instrument, of the string bass or cello type, having a socket in the bottom end for receiving a height adjusting pin; the improvement in the assembly of such pin comprising a hub having a tapered end portion which snugly fits into said socket, a cylindrical collar surrounding the opposite end portion of said hub, an end pin freely extending through said hub and collar, a substantially annular jam plate extending angularly through an angular cavity in said collar and having a central hole surrounding said end pin, a helical spring surrounding said end pin and having one end seated in said hub and the other end in engagement with said jam plate so as to normally urge the jam plate in angular relationship with the longitudinal exis of said end pin so as to wedge against two diametrically opposite, longitudinally spaced portions of said end pin to prevent it from moving longitudinally relative to said hub, said collar having an internal shoulder portion which is engageable with a peripheral portion of said jam plate upon movement of said collar toward said tapered portion of the hub and against a fulcrum portion of the hub within said collar, whereby said jam plate will tip as a lever about said fulcrum point against the action of said spring to free said end pin and allow it to be pulled away from said tapered portion to permit selective withdrawal of said end pin away from said tapered portion to enable incremental adjustment of the height of the instrument from a floor.

2. The end pin assembly recited in claim 1 together with a peripheral groove on said hub, a tail gut connected to the string tail piece of the instrument surrounding said groove to apply lateral pressure so as to anchor said hub to said socket of the instrument.

3. The end pin assembly recited in claim 1 wherein said cavity extends angularly of said hub and has openings through diametrically opposite, longitudinally offset portions of said housing.

* * * * *